United States Patent [19]

Schaeffer et al.

[11] 4,384,605

[45] May 24, 1983

[54] VALANCE SUPPORT FOR HEADRAIL

[75] Inventors: Bruce W. Schaeffer; Michael V. Brothers, both of Sturgis, Mich.

[73] Assignee: Cooper Industries, Inc., Houston, Tex.

[21] Appl. No.: 293,906

[22] Filed: Aug. 18, 1981

[51] Int. Cl.[3] ..... E06B 9/00

[52] U.S. Cl. ..... 160/38; 160/178 R; 160/19

[58] Field of Search ..... 160/19, 38, 39, 178 R, 160/178 B, 402, 404; 24/259 R, 255, 294, 295

[56] References Cited

U.S. PATENT DOCUMENTS

| | | | |
|---|---|---|---|
| 1,769,727 | 7/1930 | Walters . | |
| 2,588,332 | 3/1952 | Unwin | 160/402 X |
| 2,775,010 | 12/1956 | Bedford, Jr. . | |
| 3,136,357 | 6/1964 | Lorentzen et al. . | |
| 3,599,918 | 8/1971 | Patchett | 24/259 R |
| 4,133,507 | 1/1979 | Chervenak | 248/225.2 |
| 4,222,156 | 9/1980 | Anderle | 160/38 |

FOREIGN PATENT DOCUMENTS

| | | |
|---|---|---|
| 484783 | 3/1928 | Fed. Rep. of Germany . |
| 484784 | 5/1928 | Fed. Rep. of Germany . |
| 1148959 | 3/1969 | United Kingdom . |

*Primary Examiner*—Peter M. Caun
*Assistant Examiner*—Cherney S. Lieberman
*Attorney, Agent, or Firm*—Flynn, Thiel, Boutell & Tanis

[57] ABSTRACT

A valance comprising a support for at least one elongated strip on the front side of an upwardly opening, channel-shaped headrail for a venetian blind. The support includes a U-shaped clip having downwardly extending front and rear arms and a generally horizontal flange projecting forwardly and upwardly from the front arm. A relatively flat strip holder has a horizontal slot in the rear side thereof, the flange on the clip being receivable into and releasably held within the slot. The strip holder has two or more hook elements extending from the front side thereof which engage the lateral edges of at least one elongated strip to support the strip. Cooperating means on the clip and holder oppose relative movement thereof in the horizontal direction parallel with the headrail.

7 Claims, 6 Drawing Figures

VALANCE SUPPORT FOR HEADRAIL

FIELD OF THE INVENTION

This invention relates to a valance support mountable on the channel-shaped headrail of a venetian blind and, more particularly, relates to such a support which is adapted to hold one or more elongated flat and decorative strips which, acting like a valance, conceal the headrail of the blind.

BACKGROUND OF THE INVENTION

A venetian blind typically has a headrail or channel which is mounted along the upper side of a window casing and has a plurality of horizontal slats which are suspended in a vertically spaced relationship below the headrail by tape ladders. The headrail houses and conceals mechanisms which effect raising or lowering and tilting of the slats, but the headrail is generally not particularly aesthetically attractive. Thus, a valence is often provided to hide the headrail.

Accordingly, an object of the present invention is to provide a support mountable on the headrail of a blind which will conceal the headrail and which is decorative and aesthetically pleasing to look at.

A further object of the present invention is to provide a support, as aforesaid, which is easy to install on the blind and cannot be inadvertently disengaged therefrom.

A further object of the present invention is to provide a support, as aforesaid, which is simple and inexpensive to manufacture and is durable.

SUMMARY OF THE INVENTION

The objects and purposes of the invention, including those set forth above, are met by providing a support for at least one elongate strip on a substantially upright wall of an upwardly opening, channel-shaped headrail for a blind. The support includes a U-shaped clip having downwardly extending front and rear arms and having a generally horizontal flange projecting forwardly and upwardly from the front arm. A flat, strip holder has a generally horizontal slot in the rear side thereof, the flange on the clip being receivable into the slot for releasibly securing the holder to the clip. Structure is provided on the strip holder for securely supporting the elongated strip thereon.

In the preferred embodiment, the strip holder and clip have cooperating means for opposing lateral movement of the clip relative to the strip holder in the horizontal direction parallel with said headrail.

In said preferred embodiment, the strip holder has upper, lower and intermediate hook means on the front side thereof for engaging opposite lateral edges of two, substantially coplanar, flat and elongated strips.

BRIEF DESCRIPTION OF THE DRAWINGS

Other objects, purposes and advantages of this invention will be apparent to persons acquainted with apparatus of this general type upon reading the following description and inspecting the accompanying drawings, in which.

Figure 6:
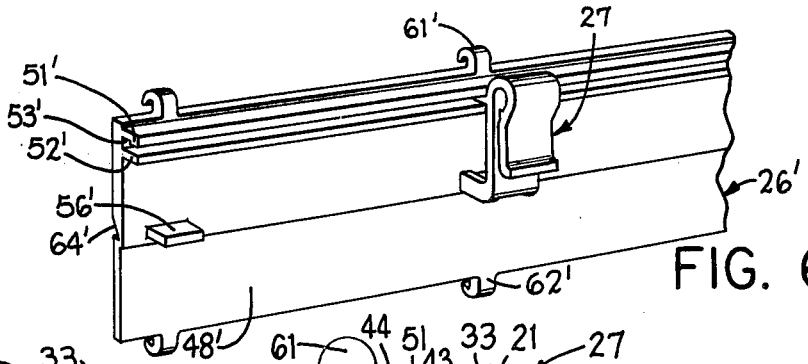
FIG. 6 is a perspective view of an alternative embodiment of the strip holder of FIG. 4.

The words "up", "down", "front" and "rear" will designate directions in the drawings to which such reference is made. The words "in", "out" and derivatives thereof will respectively refer to directions toward and away from the geometric center of the strip support and designated parts thereof.

DETAILED DESCRIPTION

Figure 1:
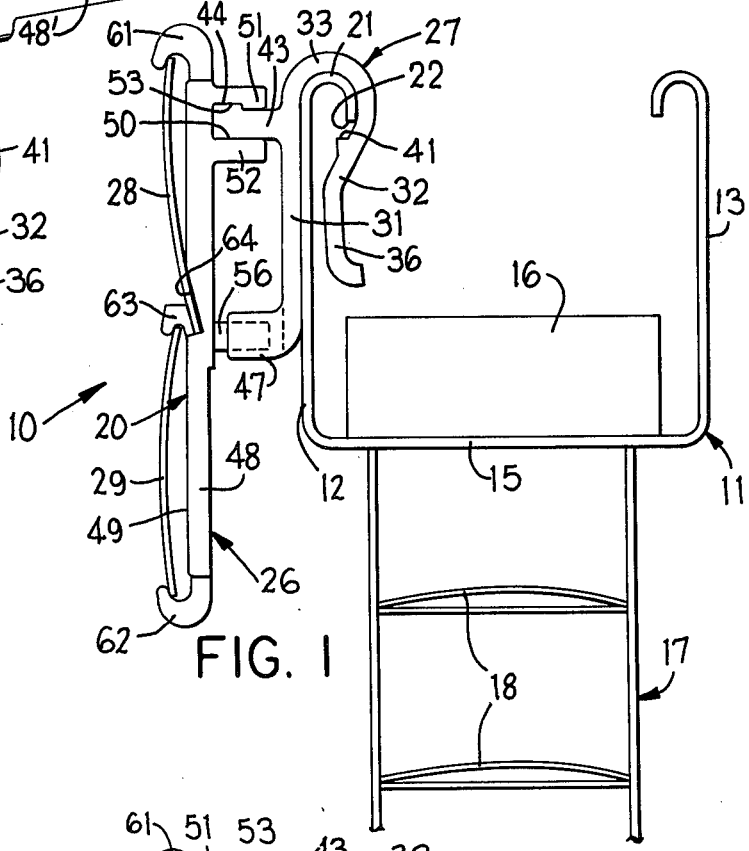
FIG. 1 is a fragmentary, end view of a venetian blind and a strip support embodying the present invention which is mounted on the headrail of the blind.

Referring to FIG. 1, a valance 10 is releasably mounted on the headrail 11 of a venetian blind. The headrail 11 is channel-shaped and has spaced front and rear walls 12 and 13, respectively, which extend upwardly from opposite edges of a substantially horizontal bottom wall 15. An operating mechanism 16 is mounted on the bottom wall 15 within the headrail 11 and a tape ladder 17 which suspends a plurality of horizontal blind slats 18 from the headrail 11. The ladder 17 extends through nonillustrated openings in the bottom wall 15 and is operatively engaged with the mechanism 16 in a conventional and nonillustrated manner. An inward return bend 21 is provided in the upper edge of the front wall 12 of the headrail 11 at the top thereof, the free edge 22 of the front wall 12 being spaced rearwardly from the remainder of the front wall 12.

The valance 10 includes one or more strip supports 20 comprising a strip holder 26, a clip 27 and, in this embodiment, a pair of elongated horizontally extending and substantially flat strips 28 and 29, which may be blind slats 18.

Figure 3:
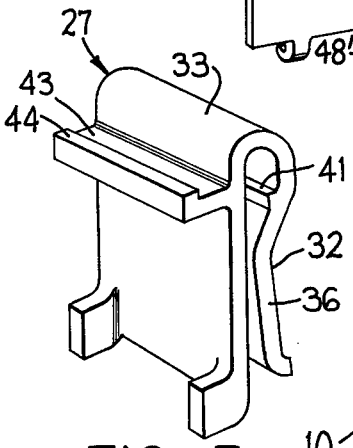
FIG. 3 is a perspective view of a clip which is a component of said support.
Figure 2:
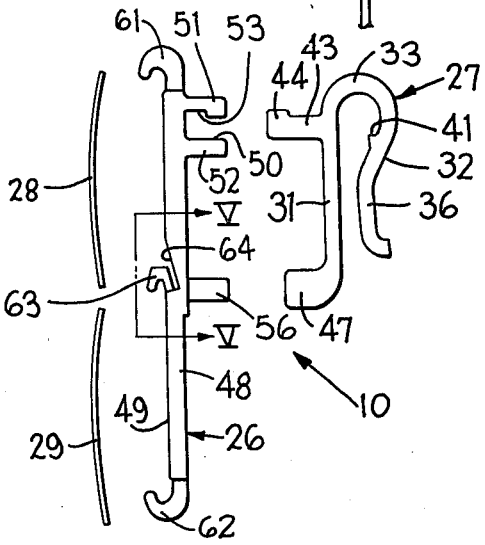
FIG. 2 is an exploded end view of the strip support illustrated in FIG. 1.

Referring to FIGS. 2 and 3, the U-shaped clip 27 has spaced, downwardly extending front and rear legs 31 and 32, respectively, which are connected at their upper ends by a bight 33. The rear leg 32 of the clip 27 has a lower portion 36 which is offset toward the front leg 31. An upwardly facing shoulder 41 is provided on the inner side of the leg 32 near the upper edge of the portion 36. As shown in FIG. 1, the shoulder 41 is cooperable with the free edge 22 of the front wall 12 of the headrail 11 to resist accidental disengagement of the clip 27 from the front wall 12 of the headrail 11. The legs 31 and 32 and the bight 33 of the clip 27 have a degree of resilient flexibility to facilitate engagement with and disengagement from the front wall 12 of the headrail.

A forwardly projecting flange 43 is provided on the front leg 31 of the clip 27 near the bight 33 and has a transversely extending, upwardly projecting ridge 44 at the end thereof remote from the front leg 31.

A pair of horizontally spaced, frontwardly projecting abutments 46 and 47 are provided at the lower end of the front leg 31 of the clip 27 for a purpose described hereinafter.

Figure 4:
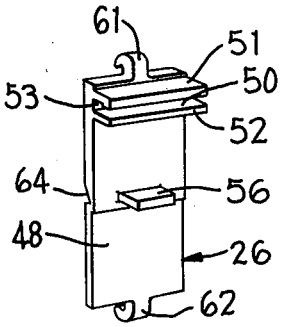
FIG. 4 is a perspective view of a strip holder which is a component of said support.

Referring to FIGS. 2 and 4, the strip holder 26 includes an upright, substantially flat face plate 48 having a substantially planar front surface 49. A pair of vertically spaced and horizontal flanges 51 and 52 project from the rear side of the face plate 48 near the top thereof, the space between the flanges 51 and 52 providing a rearwardly opening slot 50. A groove 53 is provided in the undersurface of the upper flange 51 adjacent to and parallel with the face plate 48. The slot 50 and flange 43 have L-shaped cross-sections which are interfitting and cooperate to releasably secure the holder 26 to the clip 27.

A projection 56 extends rearwardly from the face plate 48 below the flanges 51 and 52, and has a width which is preferably slightly less than the distance between the abutments 46 and 47 on the clip 27, and said projection 56 is positioned to be received between said abutments when the flange 43 is snugly disposed in the slot 50.

Top and bottom hook elements 61 and 62 (FIG. 2) are respectively secured on or near the top and bottom edges of the face plate 48. An intermediate hook element 63 is secured to the front surface 49 of the face plate 48 intermediate the top and bottom edges thereof. A horizontally extending recess 64 is provided in the front surface 49 of the face plate behind the intermediate hook element 63.

The clip 27 is releasably connected to the strip holder 26 by inserting the flange 43 of the clip 27 into the horizontal slot 50, and the upwardly projecting ridge 44 on the flange 43 is received into the groove 53, as shown in FIG. 1. The resultant interlock resists disengagement of the clip 27 from the strip holder 26. The flanges 51 and 52 of the strip holder 26 are preferably resiliently flexible in order to facilitate insertion of the flange 43 therebetween.

As the flange 43 is inserted into the slot 50 the rearward projection 56 on the strip holder 26 is received between the spaced abutments 46 and 47 on the clip 27 and prevents relative lateral movement between the clip 27 and strip holder 26 lengthwise of the headrail 11.

As illustrated in FIG. 1, the hook elements 63 and 62 respectively grip around the upper and lower lateral edges of the elongated strip 29, which is bowed slightly by such engagement so that it is securely retained by the hook elements. In a similar manner, the lower edge of the elongated strip 28 is received in the recess 64 behind the intermediate hook element 63. At the same time, the upper edge of the elongated strip 28 is gripped by the hook element 61, the elongated strip 28 being bowed slightly to effect a secure retention thereof.

While only one strip support 20 may be used, plural strip supports will normally be mounted at intervals along the headrail 11. Also, while two strips 28 and 29 are illustrated and described, it will be recognized that single, double-width strip, not shown, could be mounted between and gripped by the hook elements 61 and 62. In such case, the hook element 63 and recess 64 could be omitted.

Figure 5:
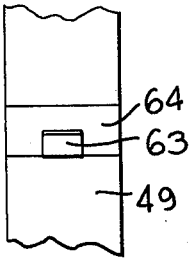
FIG. 5 is a fragment of FIG. 2 located by the cutting line VI—VI therein.

FIG. 5 illustrates an alternative strip holder 26' which is similar in several respects to the strip holder 26 of FIG. 4, and functionally equivalent parts are therefore designated by the same reference numerals with a prime (') added thereto.

The face place 48' of the strip holder 26' is horizontally elongated, and the vertically spaced, rearwardly projecting flanges 51' and 52' near the top thereof preferably extend the full length of the strip holder 26'. Rearward projections 56' are provided at spaced intervals along the strip holder 26'. Top and bottom hook elements 61' and 62', and nonillustrated intermediate hook elements are secured to the face plate 48'. A horizontal recess 64' is provided in the front surface of the strip holder 26' and extends the full length thereof.

The clips 27 and elongated strips 28, 29 utilized with the strip holder 26' may be identical to those described above with respect to the embodiment of FIGS. 1-4, and they cooperate with the strip holder 26' in substantially the same manner described above with respect to the strip holder 26.

Although preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A device for supporting at least one substantially flat and elongated strip upon the substantially upright front wall of the headrail of a venetian blind, comprising a U-shaped clip having downwardly extending front and rear legs arranged to receive at least the upper portion of said front wall snugly therebetween and having first flange means projecting frontwardly from said front leg, a strip holder having rearwardly projecting second flange means thereon, one of said first and second flange means including a substantially horizontal first flange having a vertically projecting transverse ridge adjacent the outer end thereof, and the other of said first and second flange means including two substantially horizontal and vertically spaced second flanges defining a horizontal slot, one said second flange having a transversely extending groove therein within said slot, said first flange being received in said horizontal slot and said transverse ridge thereon being received in said transverse groove to releasably interlock said clip and strip holder, cooperating means on said clip and strip holder for opposing horizontal movement of said strip holder relative to said clip in directions parallel to said transverse ridge on said first flange, and means on said strip holder for engaging the lateral edges of said elongated strip for holding said elongated strip thereon.

2. The device of claim 1, including a plurality of said clips and a single said strip holder which is horizontally elongated, said second flanges being resiliently flexible and said horizontal slot therebetween extending lengthwise of said strip holder, said first flanges of said clips being received in said horizontal slot at spaced intervals therealong.

3. The device of claim 1, including first and second said elongated strips and wherein:

said strip holder has a generally planar surface on the side thereof opposite said second flange means; and said elongated strip engaging means on said strip holder includes at least one top hook element and at least one bottom hook element respectively secured at the top and bottom edges of said front surface, at least one intermediate hook element secured on said front surface intermediate said top and bottom edges thereof, and means defining a horizontal recess in and extending along said front surface behind said intermediate hook element, said first elongated strip being disposed and gripped between said top hook and a wall defining said recess, and said second elongated strip being disposed and gripped between said intermediate and bottom hook elements.

4. The device of claim 1, including means defining a transverse, upwardly facing shoulder on the inner side of said rear leg of said clip which is adapted to engage a portion of said headrail front wall to resist inadvertent disengagement of said clip from said front wall.

5. The device of claim 1, wherein said elongated strip engaging means includes plural top hook elements secured to said strip holder near the upper edge thereof and at spaced intervals therealong, and plural bottom hook elements secured to said strip holder near the lower edge thereof and at spaced intervals therealong, said elongated strip being held snugly between said top and bottom hook elements near to and substantially parallel with said front wall of said headrail.

6. A device for supporting at least one substantially flat and elongated strip upon the substantially upright front wall of the upwardly opening, channel-shaped headrail of a venetian blind, comprising:

U-shaped clip means having downwardly extending front and rear legs arranged for reception of at least the upper portion of said front wall snugly therebetween, and having generally horizontal first flange means projecting frontwardly from said front leg;

a strip holder having rearwardly projecting second flange means defining a generally horizontal slot arranged for reception of said first flange means therein, whereby said strip holder is releasably secured to said clip means, and means on said strip holder for engaging the lateral edges of said elongated strip for holding such strip thereon; and cooperating means on said clip means and said strip holder opposing horizontal, relative movement therebetween lengthwise of said headrail, said cooperating means including a projection on one of said clip means and strip holder and a pair of spaced abutments on the other of said clip means and strip holder, the location of and the distance between said abutments being such that said projection is snugly received between said abutments when said first flange means is snugly disposed in said slot in said strip holder.

7. A device for supporting at least one substantially flat and elongated strip upon the substantially upright front wall of the upwardly opening, channel-shaped headrail of a venetian blind, comprising:

U-shaped clip means having downwardly extending front and rear legs arranged for reception of at least the upper portion of said front wall snugly therebetween, and having generally horizontal first flange means projecting frontwardly from said front leg;

a strip holder having rearwardly projecting, second flange means defining a generally horizontal slot arranged for reception of said first flange means therein, whereby said strip holder is releasably secured to said clip means, and means on said strip holder for engaging the lateral edges of said elongated strip for holding such strip thereon; and cooperating means on said clip means and said strip holder opposing horizontal, relative movement therebetween lengthwise of said headrail, said cooperating means including a rearward projection on said strip holder below said second flange means and a pair of spaced abutments projecting frontwardly from said front leg of said clip means, the location of and the distance between said abutments being such that said rearward projection is snugly received between said abutments when said first flange means is snugly disposed in said slot in said strip holder.

* * * * *